United States Patent [19]

Tardy

[11] 4,450,865

[45] May 29, 1984

[54] HYDRAULIC POWER SLIDE VALVE, ESPECIALLY DESIGNED FOR PUBLIC WORK EQUIPMENT

[75] Inventor: Maurice Tardy, St. Etienne, France

[73] Assignee: Bennes Marrel, Loire, France

[21] Appl. No.: 172,546

[22] Filed: Jul. 28, 1980

[51] Int. Cl.[3] ..... F15B 13/042

[52] U.S. Cl. ..... 137/625.6; 137/625.61; 137/625.63; 251/38

[58] Field of Search ..... 137/625.61, 625.63, 137/625.64, 625.6; 251/38

[56] References Cited

U.S. PATENT DOCUMENTS

| | | | |
|---|---|---|---|
| 2,526,709 | 10/1950 | Tait | 137/625.63 |
| 2,600,348 | 6/1952 | Walthers | 137/625.6 |
| 2,771,907 | 11/1956 | Joy | 137/625.63 X |
| 2,981,288 | 4/1961 | Strader | 137/625.6 |
| 3,089,517 | 5/1963 | Ludwig | 137/625.63 |
| 3,114,394 | 12/1963 | Panissidi | 137/625.64 |
| 3,455,334 | 7/1969 | Martinson | 137/625.61 |
| 3,583,443 | 6/1971 | Beckett et al. | 137/625.63 |
| 3,756,278 | 9/1973 | Melf | 137/625.63 |
| 3,980,001 | 9/1976 | Cyphelly | 137/625.63 |
| 4,044,795 | 8/1977 | Tardy | 137/625.6 |

FOREIGN PATENT DOCUMENTS

| | | | |
|---|---|---|---|
| 2347560 | 3/1975 | Fed. Rep. of Germany | 137/625.61 |
| 2456765 | 6/1976 | Fed. Rep. of Germany | 137/625.63 |
| 2506864 | 8/1976 | Fed. Rep. of Germany | 137/625.64 |

*Primary Examiner*—Gerald A. Michalsky

*Attorney, Agent, or Firm*—Remy J. VanOphem

[57] ABSTRACT

A hydraulic valve includes a valve body and slide, along with control pieces consisting of two thrust bearings rigidly mounted with a link which is mounted through an axial hole of the slide valve and through the axial holes of the two respective secondary pistons. The slide valve and the secondary pistons are mounted so as to provide an ample gap between the thrust bearings. The secondary pistons, located on either side of the slide valve, delineate two rear chambers which are fed with low pressure fluid. Thus, a gradual displacement of the slide valve is permitted.

18 Claims, 5 Drawing Figures

HYDRAULIC POWER SLIDE VALVE, ESPECIALLY DESIGNED FOR PUBLIC WORK EQUIPMENT

FIELD OF THE INVENTION

The present invention pertains to a hydraulic power slide valve, especially designed for public work equipment.

BACKGROUND OF THE INVENTION

This invention applies to hydraulic slide values designed to switch high pressure power systems whose pressure amounts to several hundred bars.

Usually, the actuation of these valves requires a relatively large force in order to counter balance the one produced by the high pressure.

Notwithstanding the fact that the magnitude of the efforts to be produced on the controls constitutes a disadvantage in itself, the incidental forces applied to the slide valve in order to switch the high pressure hoses interfere with the gradual displacement of the slide valve, and thus impair the accuracy of the control.

SUMMARY OF THE INVENTION

The present invention is aimed at obtaining a hydraulic slide valve which avoids the above mentioned disadvantages, and the slide valve can be used to monitor important flows of fluids.

This invention applies more particularly to a hydraulic slide valve that can be used on powerful public work equipment, on which accuracy is of prime importance for the control of multiple functions.

According to the invention, the device includes a slide valve moving longitudinally inside its body, return pieces which automatically reset the slide valve, along with control pieces which guide the slide valve. The slide valve is characterized by the fact that the control pieces include two stop pieces which are located beyond either end of the slide valve. These two stop pieces are rigidly mounted with a connecting rod passing through an axial hole of the slide valve, and through the respective axial holes of two secondary pistons. The slide valve and the two pistons are mounted in such a fashion that a predetermined gap is provided between both stop pieces. The two pistons, mounted on either side of the slide valve, slide inside a bore of the valve body. This bore is coaxial with respect to the slide valve. Within this bore, the two secondary pistons define a rear chamber which is permanently filled with fluid fed through a calibrated inlet hole, as well as a front chamber which is connected with the discharge pipe. The front chamber communicates with the rear chamber by means of an annular line provided between the connecting rod and the respective secondary piston. This hole may be sealed, to a degree, by the respective stop piece.

According to an additional characteristic of the invention, only one of the two front chambers is directly connected with a discharge, or tank return, pipe. Both front chambers permanently communicate with one another by means of an annular pipe provided between the connecting rod and the slide valve.

According to an additional characteristic of the invention, the return control pieces actuate the rigid stop piece and connecting rod assembly in such a way that they continuously tend to return this assembly to a central, neutral position. These return control pieces include two concentric elastic stacks of unequal stiffness; the softer stack is continuously actuated, whereas the stiffer one is actuated only as soon as the above assembly reaches a certain point, away from its neutral position.

According to an additional characteristic of the invention, each stop piece includes the front annular end of a control piston which slides inside a bore opening on the rear portion of the respective rear chamber, and whose rear end is located inside a control chamber. The control pressure of that chamber is variable.

According to a variation of the present invention, each stop piece includes the annular front end of a control piston which slides inside a bore opening on the rear portion of the respective rear chamber, while at least one of these two control pistons is connected with a mechanical control device.

BRIEF DESCRIPTION OF THE DRAWINGS

The attached, schematic drawings are designed to give a better understanding of the invention, of which:

FIG. 1 is a general view of a slide valve built to the specifications of the invention, shown in cross-section and following a plane that includes the slide valve's axis with the slide valve shown in the neutral position;

DETAILED DESCRIPTION OF THE PREFERRED EMBODIMENTS

Figure 2:
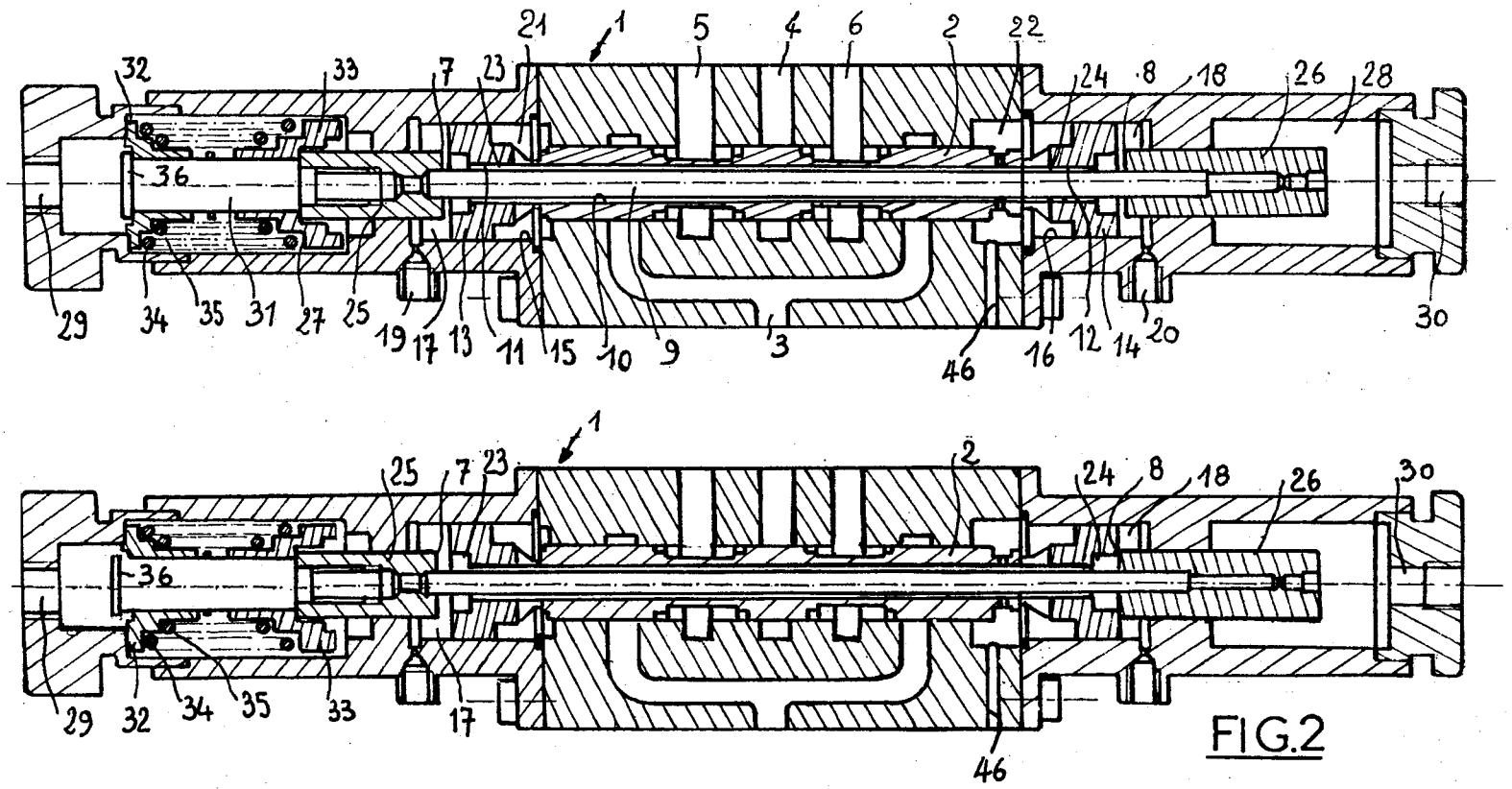
FIGS. 2 and 3 show views that are similar to that illustrated in FIG. 1 except that various operating stages of the device are shown.
Figure 3:
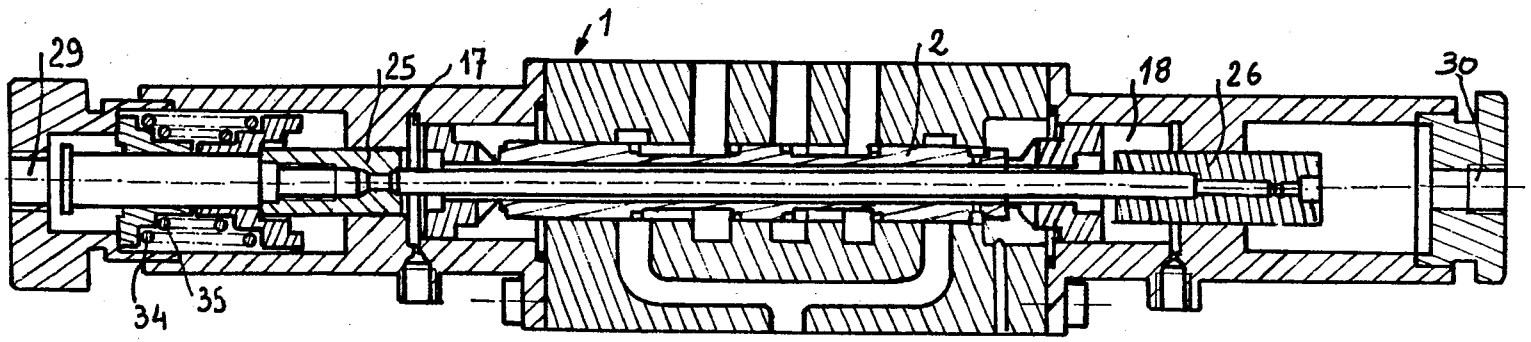

FIGS. 1–3 represent a slide valve built to the specifications of the present invention. The slide valve includes a body 1. A slide valve 2 is displaced longitudinally in the body 1 so as to switch a hydraulic power system including a feed line 3, a tank return line 4 and discharge lines 5 and 6.

The slide valve includes control pieces consisting of two stop pieces 7 and 8 which are respectively located beyond either end of the slide valve 2, and which are both rigidly mounted with the same connecting rod 9. The connecting rod 9 passes through an axial or central hole 10 in the body 1 of the slide valve and through the respective axial or central holes 11 and 12 provided in two secondary pistons 13 and 14. The slide valve 2 and the two secondary pistons 13 and 14 are mounted in such a manner as to provide an important gap between the stop pieces 7 and 8. The secondary pistons 13 and 14 which are located on either side of slide valve 2, respectively and slide in bores 15, 16 respectively, of the slide valve body 1. The bores 15 and 16 are coaxial with the slide valve 2. Each one of the secondary pistons 13, 14 respectively delineate, within their respective bores 15, 16, a rear chamber 17, 18 respectively, which is fed with low pressure fluid through calibrated inlet holes 19, 20, and a front chamber 21 or 22 on the side adjacent to the slide valve 2. Each front chamber 21, 22 respectively, opens to the respective rear chamber 17, 18 through an annular line 23, 24 respectively, provided in an annulus between the connecting rod 9 and the slide valve 2.

The front chamber 22 is connected with a discharge or tank return line 46.

Each stop piece 7, 8 respectively, is comprised of a front portion of a control piston 25, 26 respectively. The control pistons 25, 26 slide inside chambers opening to the rear of the respective rear chambers 17, 18. The rear end of the pistons 25, 26 respectively, being housed in a control chamber 27, 28 respectively, which are connected with channel pipes 29, 30 respectively.

The rear end of the control piston 25 is subjected to the action of the return control pieces, housed in the control chamber 27, and designed to bring the slide valve 2 back to a central, neutral position. These return control pieces include a pin or shaft 31, two washers 32, 33, as well as two concentric, elastic stacks or coil springs 34, 35, respectively. Both washers 32 and 33 slide freely along the pin 31, between the rear end of the control piston 25 and a head 36 of the pin 31. Both washers 32, 33 respectively, are also designed to move longitudinally in the control chamber 27, between the front and rear counterbores of that chamber. The external elastic stack 34, the softer one, is continuously compressed between the washers 32 and 33. The internal elastic stack 35, the stiffer one, is located between both washers but is not actuated whenever the slide valve and the rigid assembly, including the connecting rod 9 and the control pistons 25 and 26, are in a neutral position. This internal elastic stack 35 only starts to be compressed as the rigid assembly reaches a certain predetermined point, away from a neutral position, that is the point where the washers 32 and 33 become sufficiently close to one another.

Figure 4:
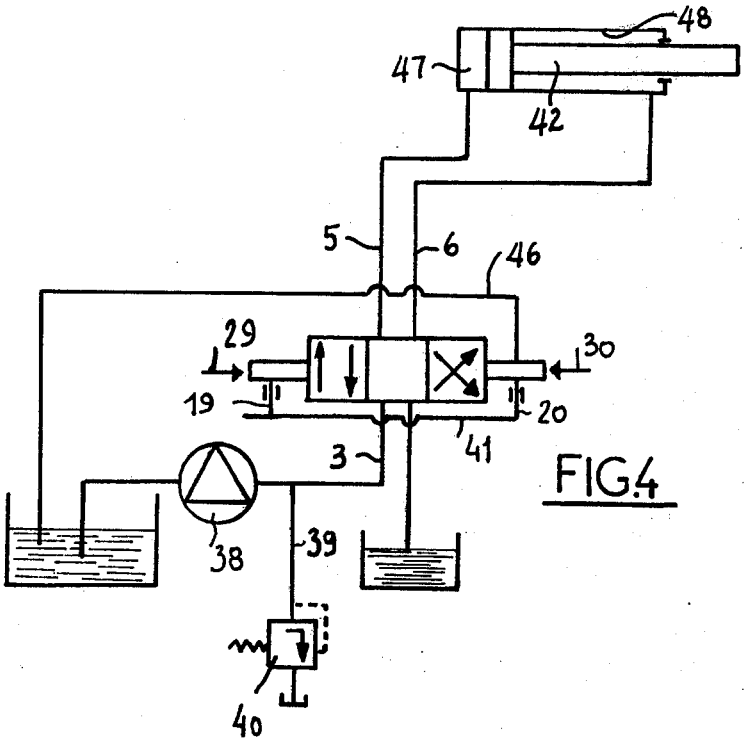
FIG. 4 is a schematic illustration of the various slide valve circuits.

FIG. 4 illustrates the schematic hydraulic connection diagram for the slide valve according to my invention.

The feed line 3 is connected with a high pressure pump 38. The pump 38 includes a by-pass 39 which is connected with a pressure-regulating valve 40 calibrated to the appropriate value.

The calibrated inlet holes 19 and 20 are continuously fed with low pressure fluid by a single feed pipe 41.

The channel pipes 29, 30 which respectively open to control the chambers 27, 28 respectively, are used to obtain various low control pressures.

The discharge lines 5 and 6 feed both opposite pressure chambers 47 and 48 respectively of reciprocating cylinder 42.

The high pressure obtained in the feed pipe 3 may range from 250 to 400 bars, whereas the pressure, inside the feed pipe 41 ranges from 15 to 35 bars. Incidentally, these values represent the maximum pressures in the channel pipes 29 and 30.

The mode of operation is as follows.

When no pressure is applied in the channel pipes 29 and 30 and therefore, when the elastic stacks 34 and 35 hold the slide valve 2 in a neutral position, the fluid under pressure which is sent to the rear chambers 17 and 18 through the feed pipe 41 returns to the tank through the annular line 4 and the discharge pipe 46. This position is illustrated in FIG. 1.

If a control pressure, applied to the channel pipe 30, starts to cause a slight displacement to the left of the control pistons 25 and 26 as shown on FIG. 2, the stop piece 8 is immediately actuated so as to seal the annular line 24. Thus, the pressure in the rear chamber 18 is increased. This pressure increase displaces, in effect, the slide valve 2 to the left to compress the elastic stacks 34, 35.

It may occur that, under the effect of incidental pressure forces applied to the high pressure system, the slide valve 2 is moving forward at a faster speed than the control pistons 25 and 26. In this case, the annular line 23 is obstructed by the action of the stop piece 7, in order to increase the pressure in the rear chamber 17 and hold the slide valve 2 in position.

The pressure of rear the chambers 17 and 18 remains automatically regulated with respect to the resisting forces applied to the slide valve, so that the pressure forces issuing from the rear chambers 17 and 18 are sufficient to cause the displacement of the slide valve. The only effort required on the control pistons 25 and 26 is that required to compensate for the return forces of the elastic stacks 34 and 35. In other words, the auxiliary efforts represented by the pressure forces which are applied to the slide valve 2 at the level of the rear chambers 17 and 18 are always proportionate with the control effort required on slide valve 2 itself, with all incidental forces issuing from the high pressure system being considered.

As soon as the slide valve 2 reaches a predetermined longitudinal position, the pressure sent into the channel pipes 29 or 30 does not vary anymore, and the forces applied to the control pistons are exactly balanced by the pressure produced by the elastic stacks 34 and 35, as shown in FIG. 3. The auxiliary effort, however, remains entirely available as soon as an incidental force is applied on the slide valve.

Figure 5:
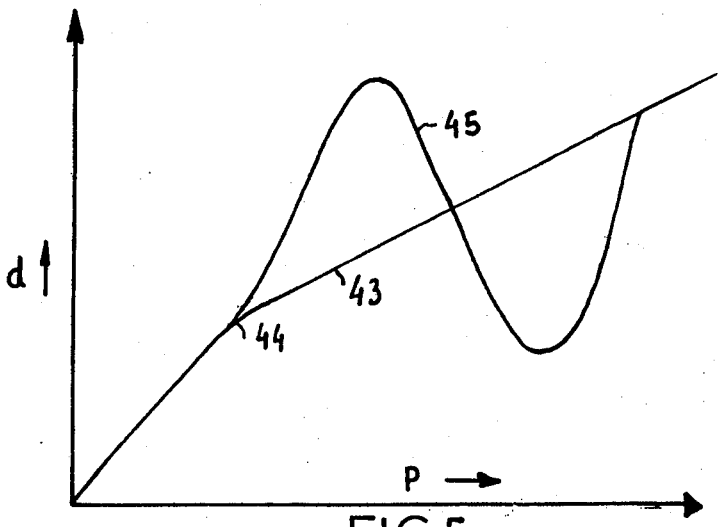
FIG. 5 is a diagram indicating the operating characteristics of the slide valve.

The curve 43 of FIG. 5, shows the variations affecting the displacement d of the slide valve 2, with respect to the pressure P of one of the control chambers, for instance, and in the control chamber 28 in particular. It should be noted that this diagram shows a gradual increase, the angular change at point 44 represents the actuation of the stiffer elastic stack 35.

Using a slide valve without the present device, the diagrams obtained are similar to the curve 45. These diagrams are significantly distorted and are unstable, due to the incidental reactions affecting the slide valve.

Even though the control described herein is hydraulic, it would also be possible to use a mechanical type control, or even an electrical control, since all of these controls actuate the control pistons 25 and 26.

The present slide valve offers the following advantages:

The auxiliary effort is supplied by a relatively low pressure and a constant discharge flow, which contributes to the stability of the slide valve displacement, by avoiding any "knocking."

The secondary system pressure may be obtained through retrieval from the various leak or overflow systems of the public work type machines.

A very low amount of force may be sufficient to control the slide valve, which remains able to monitor heavy flows, so as to operate powerful receivers. Such a device is particularly appropriate to operate multifunction, public work machines.

The present system practically eliminates all distortions from the specific diagram of the slide valves, and the curve 43 thus obtained is quite uniform, as shown on FIG. 5.

While the invention has been described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

What is claimed is:

1. A hydraulic fluid valve utilizing a source of hydraulic fluid in a hydraulic system, said valve comprising:

a valve body having one end, an opposite end, and a valve bore located in said valve body, said valve bore extending from said one end to said opposite end, said valve body further having at least one feed line passage extending from said valve bore for flow communication therewith; at least two discharge line passages, each of said at least two discharge line passages extending from said valve bore and disposed a predetermined distance from said at least one feed line passage for flow communication between said at least one feed line passage and each of said at least two discharge line passages; and a tank return line passage adjacent but spaced away from each of said at least two discharge line passages for flow communication between each of said at least two discharge line passages and said tank return line passage;

a connecting rod mounted within said valve bore of said valve body, said connecting rod having a first end extending beyond said one end of said valve body and a second end opposite said first end, said second end extending beyond said opposite end of said valve body;

slide valve means, mounted to said connecting rod, for controlling the flow of said hydraulic fluid between said at least one feed line passage and one of said at least two discharge line passages when said slide valve means is in a first predetermined position, said slide valve means further controlling the flow of said hydraulic fluid between said at least one feed line passage and another of said at least two discharge line passages when said slide valve means is in a second predetermined position, said slide valve means terminating fluid communication between said at least one feed line passage and at least one of said at least two discharge line passages when said slide valve means is in a third predetermined position, said another of said at least two discharge line passages communicating with said tank return line passage when said slide valve means is in said first predetermined position, said one of said at least two discharge line passages communicating with said tank return line passage when said slide valve means is in said second predetermined position;

connecting rod moving means for moving said connecting rod a predetermined distance independently of the movement of said slide valve means such that said connecting rod moving means allows movement of said connecting rod for said predetermined distance as said slide valve means is moved to one of said predetermined positions, said connecting rod moving means further comprising:

(a) a first end cap member mounted to said one end of said valve body, said first end cap member having a first sealed cavity therein adjacent to said valve body, a second sealed cavity therein spaced a predetermined distance therefrom, and a reduced diameter passage interposed said first and second sealed cavities;

(b) a first control piston member rigidly mounted to said first end of said connecting rod for movement therewith, said first control piston further being sealingly mounted in said reduced diameter passage of said first end cap member, said first control piston further forming a seal between said first and second sealed cavities and having one end portion extending into said first sealed cavity and an opposite end portion extending into said second sealed cavity of said first end cap member;

(c) first biasing means for biasing said first control piston, said first biasing means being mounted in said second sealed cavity of said first end cap member;

(d) a second end cap member mounted to said opposite end of said valve body, said second end cap member having a third sealed cavity therein adjacent to said valve body, a fourth sealed cavity therein spaced a predetermined distance therefrom, and a reduced diameter passage interposed said third and fourth sealed cavities;

(e) a second control piston member rigidly mounted to said second end of said connecting rod for movement therewith, said second control piston being sealingly mounted in said reduced diameter passage of said second end cap member, said second control piston further forming a seal between said third and fourth sealed cavities and having one end portion extending into said third sealed cavity and an opposite end portion extending into said fourth sealed cavity of said second end cap member;

(f) inlet passage means for said first and third sealed cavities interconnected with a source of pressurized fluid;

(g) outlet passage means for said third sealed cavity of said second end cap member;

(h) intermediate passage means interposed said connecting rod and said slide valve means for establishing fluid communication between said first sealed cavity of said first end cap member and said third sealed cavity of said second end cap member; and (i) valving means for terminating said fluid communication between said first sealed cavity of said first end cap member and said third sealed cavity of said second end cap member such that said connecting rod moves a predetermined distance to actuate said valving means to terminate communication between said first and third sealed cavities independently of said movement of said slide valve means;

slide valve moving means for moving said slide valve means in said valve body such that when said slide valve moving means moves said slide valve means to one of said predetermined positions, said connecting rod moving means allows said connecting rod to move said predetermined distance independently of said slide valve moving means and to thereby provide smooth displacement of said slide valve means and stablize erratic movement of said slide valve means due to unforseen distortions in the hydraulic fluid system; and fluid supply means for supplying first control hydraulic fluid under pressure to said slide valve moving means so as to enable selective movement of said slide valve means.

2. The hydraulic fluid valve as claimed in claim 1 wherein said slide valve moving means for moving said slide valve means in said valve body further comprises connecting rod actuation means for actuating said connecting rod and biasing means mounted to said valve body in spaced relationship to said connecting rod moving means.

3. The hydraulic fluid valve as claimed in claim 1 wherein said valving means for terminating communication between said first sealed cavity of said first end cap member and said third sealed cavity of said second end cap member comprises:

a first secondary piston member mounted in said first sealed cavity of said first end cap member, said first secondary piston member defining a first chamber between said first secondary piston member and said valve body and a second chamber between said first secondary piston member and said reduced diameter passage of said first end cap member;

a second secondary piston member mounted in said third sealed cavity of said second end cap member, said second secondary piston member defining a third chamber between said second secondary piston member and said valve body and a fourth chamber between said second secondary piston member and said reduced diameter passage of said second end cap member;

a first annular passage in said first secondary piston member extending between said first and second chambers for communication therebetween, said first annular passage further communicating with said intermediate passage means interposed said connecting rod and said slide valve means;

a second annular passage in said second secondary piston member, said second annular passage extending between said third and fourth chambers for communication therebetween, said second annular passage further communicating with said intermediate passage means interposed said connecting rod and said slide valve means; and second biasing means for biasing said first control piston, said second biasing means mounted in said second sealed cavity of said first end cap member.

4. The hydraulic fluid valve as claimed in claim 3 wherein said first biasing means for biasing said first control piston comprises:

a first washer member mounted in said second sealed cavity of said first end cap member;

a second washer member mounted in said second sealed cavity of said first end cap member in spaced relationship to said first washer member;

a preloaded compression spring mounted between said first and second washer members, said preloaded compression spring responsive to axial movement of said first control piston member; and wherein said second means for biasing said first control piston comprises a second compression spring mounted between said first and second washer members, said second compression spring being unloaded when said slide valve means is in said third predetermined position.

5. The hydraulic fluid valve as claimed in claim 3 further comprising slide valve moving means for moving said slide valve means in said valve body, said slide valve moving means comprising:

control rod actuating means for actuating said connecting rod, said actuating means being adapted to communicate with said opposite end portion of each of said first and second control piston members to move said opposite end portion of said first and second control piston members in response to a predetermined force exerted thereon; and biasing means for biasing said slide valve means, said biasing means mounted in said second sealed cavity of said first end cap member, said biasing means further including a stop member mounted to said first end cap member, said stop member having a passage therethrough.

6. The hydraulic fluid valve as claimed in claim 3 further comprising connecting rod actuation means for actuating said connecting rod and biasing means mounted to said valve body in spaced relationship to said means for moving said connecting rod.

7. The hydraulic fluid valve as claimed in claim 1 wherein said means for moving said slide valve means in said valve body further comprises:

connecting rod actuation means for actuating said connecting rod, said connecting rod actuation means being adapted to communicate with said opposite end portion of each of said first and second control piston members to move said opposite end portion of said first and second control piston members in response to a predetermined force exerted thereon; and biasing means for biasing said slide valve means, said biasing means mounted in said second sealed cavity of said first end cap member, said biasing means further including a stop member mounted to said first end cap member, said stop member having a passage therethrough.

8. The hydraulic fluid valve as claimed in claim 1 wherein said first biasing means for biasing said first control piston member comprises:

a first washer member mounted in said second sealed cavity of said first end cap member;

a second washer member mounted in said second sealed cavity of said first end cap member in spaced relationship to said first washer member; and a preloaded compression spring mounted between said first and second washer members, said preloaded compression spring responsive to axial movement of said first control piston member.

9. In a hydraulic fluid valve utilizing a source of hydraulic fluid in a hydraulic system and having a valve body with one end and an opposite end, a valve bore through said valve body extending from said one end to said opposite end, at least one feed line passage and at least one discharge line passage extending from said valve bore, a connecting rod mounted within said valve bore of said valve body and including a first end extending beyond one end of said valve body and a second end extending beyond said opposite end of said valve body, slide valve means mounted to said connecting rod for controlling the flow of hydraulic fluid from said at least one feed line passage to said at least one discharge line passsage and movable independently of said connecting rod, and means for moving said connecting rod, the improvement wherein said means for moving said connecting rod comprises:

a first end cap member mounted to said one end of said valve body, said first end cap member having a first sealed cavity therein adjacent to said valve body, a second sealed cavity therein spaced a predetermined distance therefrom, and a reduced diameter passage interposed said first and second sealed cavities;

a first control piston member rigidly mounted to said first end of said connecting rod for movement therewith, said first control piston further being sealingly mounted in said reduced diameter passage of said first end cap member, said first control piston further forming a seal between said first and second sealed cavities and having one end portion extending into said first sealed cavity and an opposite end portion extending into said second sealed cavity of said first end cap member;

first biasing means for biasing said first control piston, said first biasing means being mounted in said second sealed cavity of said first end cap member;

a second end cap member mounted to said opposite end of said valve body, said second end cap member having a third sealed cavity therein adjacent to said valve body, a fourth sealed cavity therein spaced a predetermined distance therefrom, and a reduced diameter passage interposed said third and fourth sealed cavities;

a second control piston member rigidly mounted to said second end of said connecting rod for movement therewith, said second control piston being sealingly mounted in said reduced diameter passage of said second end cap member, said second control piston further forming a seal between said third and fourth sealed cavities and having one end portion extending into said third sealed cavity and an opposite end portion extending into said fourth sealed cavity of said second end cap member;

inlet passage means for said first and third sealed cavities interconnected with a source of pressurized fluid;

outlet passage means for said third sealed cavity of said second end cap member;

intermediate passage means interposed said connecting rod and said slide valve means for establishing fluid communication between said first sealed cavity of said first end cap member and said third sealed cavity of said second end cap member; and valving means for terminating said fluid communication between said first sealed cavity of said first end cap member and said third sealed cavity of said second end cap member such that said connecting rod moves a predetermined distance to actuate said valving means to terminate communication between said first and third sealed cavities independently of said movement of said slide valve means.

10. The hydraulic fluid valve as claimed in claim 9 wherein said valving means for terminating communication between said first sealed cavity of said first end cap member and said third sealed cavity of said second end cap member comprises:

a first secondary piston member mounted in said first sealed cavity of said first end cap member, said first secondary piston member defining a first chamber between said first secondary piston member and said valve body and a second chamber between said first secondary piston member and said reduced diameter passage of said first end cap member;

a second secondary piston member mounted in said third sealed cavity of said second end cap member, said second secondary piston member defining a third chamber between said second secondary piston member and said valve body and a fourth chamber between said second secondary piston member and said reduced diameter passage of said second end cap member;

a first annular passage in said first secondary piston member extending between said first and second chambers for communication therebetween, said first annular passage further communicating with said intermediate passage means interposed said connecting rod and said slide valve means;

a second annular passage in said second secondary piston member, said second annular passage extending between said third and fourth chambers for communication therebetween, said second annular passage further communicating with said intermediate passage means interposed said connecting rod and said slide valve means; and second biasing means for biasing said first control piston, said second biasing means mounted in said second sealed cavity of said first end cap member.

11. The hydraulic fluid valve as claimed in claim 10 wherein said slide valve moving means for moving said slide valve means in said valve body further comprises:

control rod actuation means for actuating said connecting rod, said control rod actuation means being adapted to communicate with said opposite end portion of each of said first and second control piston members to move said opposite end portion of said first and second control piston members in response to a predetermined force exerted thereon; and biasing means for biasing said slide valve means, said biasing means mounted in said second sealed cavity of said first end cap member, said biasing means further including a stop member mounted to said first end cap member, said stop member having a passage therethrough.

12. The hydraulic fluid valve as claimed in claim 10 further comprising connecting rod actuation means for actuating said connecting rod and biasing means mounted to said valve body in spaced relationship to said means for moving said connecting rod.

13. The hydraulic fluid valve as claimed in claim 12 wherein said means for actuating said connecting rod comprises:

means for supplying a second control hydraulic fluid under pressure to said second sealed cavity of said first end cap member and said fourth sealed cavity of said second end cap member, whereby an unbalance between the pressure in said second sealed cavity of said first end cap member and the pressure in said fourth sealed cavity of said second end cap member causes a force to move said connecting rod.

14. The hydraulic fluid valve as claimed in claim 12 wherein said connecting rod actuation means for actuating said connecting rod comprises a force applied to said opposite end portion of said second control piston member extending into said fourth sealed cavity of said second end cap member.

15. The hydraulic fluid valve as claimed in claim 10 wherein said first biasing means for biasing said first control piston comprises:

a first washer member mounted in said second sealed cavity of said first end cap member;

a second washer member mounted in said second sealed cavity of said first end cap member in spaced relationship to said first washer member;

a preloaded compression spring mounted between said first and second washer members, said preloaded compression spring responsive to axial movement of said first control piston member; and wherein said second means for biasing said first control piston comprises a second compression spring mounted between said first and second washer members, said second compression spring being unloaded when said slide valve means is in said third predetermined position.

16. The hydraulic fluid valve as claimed in claim 9 wherein said slide valve moving means for moving said slide valve means in said valve body further comprises:

connecting rod actuation means for actuating said connecting rod, said connecting rod actuation means being adapted to communicate with said opposite end portion of each of said first and second control piston members to move said opposite end portion of said first and second control piston members in response to a predetermined force exerted thereon; and biasing means for biasing said slide valve means, said biasing means mounted in said second sealed cavity of said first end cap member, said biasing means further including a stop member mounted to said first end cap member, said stop member having a passage therethrough.

17. The hydraulic fluid valve as claimed in claim 9 wherein said first biasing means for biasing said first control piston comprises:

a first washer member mounted in said second cavity of said first end cap member;

a second washer member mounted in said second sealed cavity of said first end cap member in spaced relationship to said first washer member; and a preloaded compression spring mounted between said first and second washer members, said preloaded compression spring responsive to axial movement of said first control piston member.

18. The hydraulic fluid valve as claimed in claim 9 further comprising slide valve moving means for moving said slide valve means in said valve body said slide valve moving means comprising connecting rod actuation means for actuating said connecting rod and biasing means mounted to said valve body in spaced relationship to said means for moving said connecting rod.

* * * * *

UNITED STATES PATENT AND TRADEMARK OFFICE

CERTIFICATE OF CORRECTION

PATENT NO. : 4,450,865

DATED : May 29, 1984

INVENTOR(S) : Maurice Tardy

It is certified that error appears in the above-identified patent and that said Letters Patent is hereby corrected as shown below:

Column 3, line 28, after "point" delete the comma ",".

Column 4, line 5, delete "rear the" and insert ---- the rear ----.

Column 4, line 9, after "valve" insert ---- 2 ----.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*